US005985132A

United States Patent [19]

Hoehn et al.

[11] Patent Number: 5,985,132

[45] Date of Patent: Nov. 16, 1999

[54] PROCESS FOR THE SIMULTANEOUS PRODUCTION OF LUBRICATING OIL BASE STOCKS AND MOTOR FUEL

[75] Inventors: Richard K. Hoehn, Mount Prospect; Vasant P. Thakkar, Elk Grove Village, both of Ill.

[73] Assignee: UOP LLC, Des Plaines, Ill.

[21] Appl. No.: 08/957,236

[22] Filed: Oct. 24, 1997

[51] Int. Cl.[6] ..... C10G 47/00

[52] U.S. Cl. ..... 208/58; 208/60; 208/61; 208/74

[58] Field of Search ..... 208/59, 60, 74, 208/61, 58

[56] References Cited

U.S. PATENT DOCUMENTS 5,013,422 5/1991 Absil et al. ..... 208/59
5,288,395 2/1994 Marler ..... 208/58
5,358,628 10/1994 Apelian ..... 208/60
5,462,650 10/1995 Takito ..... 208/58
5,643,440 7/1997 Borghard et al. ..... 208/58

*Primary Examiner*—Helane Myers
*Attorney, Agent, or Firm*—Thomas K. McBride; John G. Tolomei; John G. Cutts, Jr.

[57] ABSTRACT

A process for the simultaneous production of lubricating blending stocks by means of hydrocracking a hydrocarbon feedstock in a first hydrocracking zone to convert at least a portion of the heavy hydrocarbon feedstock to produce an effluent stream containing lube oil boiling range hydrocarbons. One portion of the effluent stream is directly removed from the first hydrocracking zone to produce high quality lube oil blending stocks. Another portion of the effluent stream from the first hydrocracking zone is directly introduced into a second hydrocracking zone without intermediate separation. The second hydrocracking zone is utilized to further crack the feed to produce motor fuel.

8 Claims, 1 Drawing Sheet

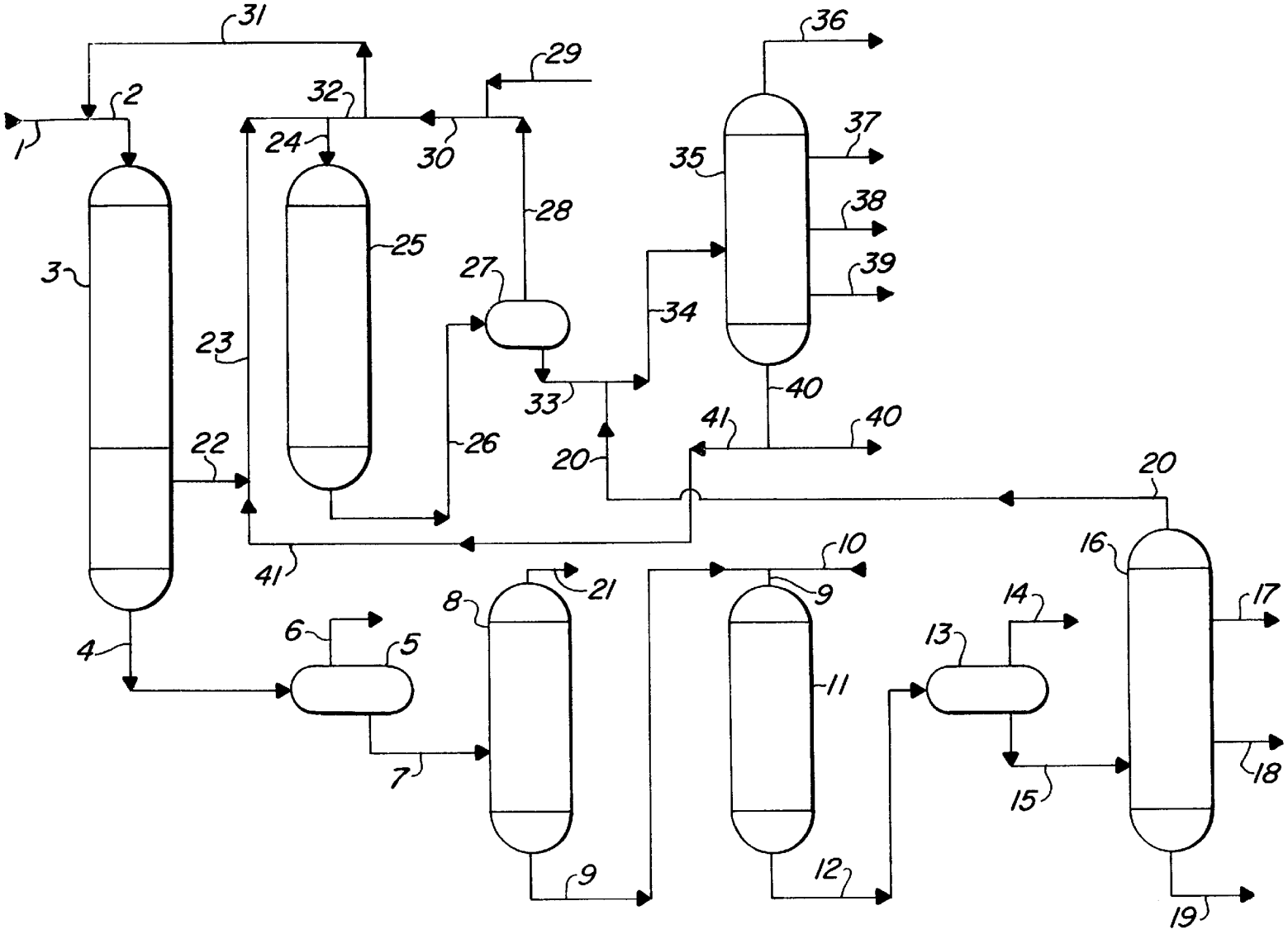
1
2
3
4
5
6
7
8
9
10
11
12
13
14
15
16
17
18
19
20
21
22
23
24
25
26
27
28
29
30
31
32
33
34
35
36
37
38
39
40
41

PROCESS FOR THE SIMULTANEOUS PRODUCTION OF LUBRICATING OIL BASE STOCKS AND MOTOR FUEL

BACKGROUND OF THE INVENTION

The field of art to which this invention pertains is the conversion of heavy hydrocarbon feedstocks to produce lubricating oil base stocks and motor fuel. More specifically, the invention withdraws an intermediate hydrocracked stream to produce lube oil base stock having high viscosity while simultaneously producing large quantities of motor fuel in a hydrocracking process.

INFORMATION DISCLOSURE

World crude oil supply constraints are requiring refiners to use poorer quality crude oils to produce high quality lubricating oils. High quality lubricating oils must have a high viscosity index (hereinafter VI), low volatility, good low temperature fluidity and high stability. Some of these properties can be achieved by solvent refining certain high grade crude oils, but these crude oils are becoming less available and more expensive.

The poorer quality crude oils remaining tend to have higher concentrations of aromatic compounds and asphaltenes in the heavier portion of the feedstock which are not appropriate to produce neutral base stocks and bright stocks. In hydrocracking, the desired reactions are the saturation of polyaromatics and the opening of polynaphthenic molecules into branched paraffinic molecules. Hydrodewaxing essentially selectively hydrocracks normal paraffins, reducing the molecular weight and length of the molecules. Heavy hydrocarbon stocks, herein defined as those boiling above 650° F., can be processed by hydrocracking to produce acceptable lubricating oil base stocks by saturating multi-ring compounds and cracking of normal paraffins to below the molecular weight range of neutral stocks. Therefore, a poorer quality crude oil can be upgraded to make an acceptable lubricating oil base stock by a combination of hydrocracking and hydrodewaxing.

Poorer quality crude oils are theoretical candidates for a new source of lubricating oil base stocks. However, the distillation of such crude oils and subsequent solvent extraction normally produces poor quality lubricating oil base stock fractions. The lubricating oil base stocks produced have an unacceptably high concentration of aromatic and naphthenic components. But if commercially acceptable hydroprocessing conditions are employed, then a number of difficulties will be encountered. Among the difficulties is that hydroprocessing the crude oil to remove aromatic components produces a product containing high concentrations of naphthenic components. Naphthenic components are known to degrade the VI of the resulting lubricating oil base stocks. Removal of the naphthenic components by hydroprocessing requires high temperatures and pressures. Furthermore, aromatic components tend to consume large amounts of hydrogen during hydrogenation. If these difficulties could be overcome, then a significant advantage would be gained. Then high quality lubricating oil base stocks could be produced from poorer quality crude oils.

In addition, it is frequently desired to maximize production of motor fuel while simultaneously producing high quality lube oil base stocks. However, lube oil markets in most instances are not very large when compared to the total feedstock availability for the hydrocracking conversion process. Therefore, there is a great need to simultaneously produce lube oil base stocks at a flexible rate from a motor fuel hydrocracking unit. Hydrocracking of vacuum gas oils and heavier feeds to produce lube oils is restricted to low conversion in order to produce base stocks over a specific viscosity range. On the other hand, the fuels applications need higher conversions. In accordance with the present invention, these two conflicting routes are successfully integrated by withdrawing the typically required amount of unconverted product from the first hydrocracking reaction zone for lube oil production and directing the remainder of the effluent from the first hydrocracking reaction zone to a second hydrocracking reaction zone for further conversion to motor fuel products.

BRIEF SUMMARY OF THE INVENTION

The present invention provides a process for the simultaneous production of lubricating blending stocks by means of hydrocracking a heavy hydrocarbon feedstock in a first hydrocracking zone to convert at least a portion of the heavy hydrocarbon feedstock to produce an effluent stream containing lube oil boiling range hydrocarbons. At least a portion of the effluent stream is directly removed from the first hydrocracking zone to produce high quality lube oil blending stocks. At least another portion of the effluent stream from the first hydrocracking zone is directly introduced into a second hydrocracking zone without intermediate separation. The second hydrocracking zone is utilized to further crack the feed to produce motor fuel.

One embodiment of the present invention may be characterized as a process for the production of lubricating oil base stocks comprising: (a) hydrocracking a heavy hydrocarbon feedstock comprising essentially all of its components boiling above about 650° F. in a first hydrocracking zone with hydrogen under conditions to convert at least about 20% of the feedstock into components boiling at less than about 650° F. to produce a liquid stream comprising unconverted hydrocarbon compounds and lube oil boiling range hydrocarbons; (b) withdrawing at least a portion of the liquid stream produced in step (a) from the first hydrocracking zone and producing at least one hydrocarbon stream having a boiling range below about 700° F. comprising lube oil boiling range hydrocarbon; (c) hydrodewaxing the stream comprising lube oil boiling range hydrocarbon in a hydrodewaxing reaction zone to produce at least one lubricating oil base stock; (d) withdrawing at least another portion of the liquid stream produced in step (a) from the first hydrocracking zone and introducing the another portion of the liquid stream into a second hydrocracking zone with hydrogen under hydrocracking conditions to produce a liquid stream comprising unconverted hydrocarbon compounds and hydrocarbons boiling at less than about 650° F.; (e) separating at least a portion of the liquid stream produced in step (d) to produce at least one hydrocracked product stream having a boiling range less than about 650° F.

Other embodiments of the present invention encompass further details such as preferred feedstocks, hydrocracking catalysts and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

Suitable feedstocks include distillable hydrocarbons preferably having boiling points above about 650° F. Some of these feedstocks are commonly referred to as heavy distillates, gas oils, vacuum gas oils and deasphalted oil (DAO). These feedstocks are prepared by fractionating crude oil in atmospheric and/or vacuum fractionation zones and solvent deasphalting residual crude oil.

In accordance with the present invention, the heavy hydrocarbon feedstock is introduced into a first hydrocracking zone which is typically operated in downflow fashion and contains a hydrocracking catalyst comprising a hydrogenation component, for example a Group VIII metal component and/or a Group VIB metal component, generally dispersed on a support. More specifically, the hydrocracking catalyst typically contains between 5 and 50 weight percent of a Group VIB metal component, measured as the trioxide, and/or between 2 and 20 weight percent of a Group VIII metal component, measured as the monoxide, supported on a suitable refractory oxide. Although alumina is the preferred support, other refractory oxides are also suitable, for example, silica, silica-alumina, silica-magnesia and silica-titania. The catalyst can be produced by conventional methods including impregnating a preformed catalyst support. Other methods include cogelling, co-mulling or precipitating the catalytic metals with the catalyst support followed by calcination. Preferred catalysts contain amorphous oxide supports which are extruded and subsequently impregnated with catalytic metals.

The first hydrocracking zone is preferably operated at conditions which include a temperature from about 450° F. to about 750° F., a pressure from about 1500 psig to about 2500 psig, and a liquid hourly space velocity from about 0.5 to about 5 $hr^{-1}$. The operating conditions in the first hydrocracking zone are selected to preferably convert at least about 20% of the feedstock.

A liquid stream containing lube oil boiling range hydrocarbons is directly removed from the first hydrocracking reaction zone and is flashed and stripped to remove hydrogen, normally gaseous hydrocarbons and other hydrocarbons boiling at a temperature lower than the lube oil boiling range. The resulting flashed and stripped lube oil boiling range hydrocarbons are introduced together with hydrogen into a hydrodewaxing reaction zone containing a dewaxing catalyst, preferably comprising a dewaxing component, for example, an intermediate pore molecular sieve. Preferably, the dewaxing catalyst is a hydrodewaxing catalyst comprising a hydrogenating component on a support containing a dispersion of an intermediate pore molecular sieve in a porous refractory oxide. Examples of such preferred catalysts typically comprise between 5 and 50 weight percent of a Group VIB metal component and/or from about 2 to about 20 weight percent of a Group VIII metal component together with a dewaxing component on a suitable refractory oxide. Preferred Group VIII metals include nickel and cobalt, and preferred Group VIB metals include molybdenum and tungsten. One of the most preferred hydrogenation component combinations is nickel-tungsten. Suitable refractory oxides include silica, silica-alumina, silica-magnesia, silica-titania and the like with alumina being preferred. The catalyst preferably comprises an intermediate pore crystalline molecular sieve having cracking activity, such as silicalite or an aluminosilicate having a high ratio of silica. Preferred catalysts include a support comprising the intermediate pore molecular sieve dispersed in an alumina matrix. Such supports can be produced, for example, by extruding a mixture of a 30 weight percent molecular sieve dispersion in 70 weight percent alumina. The alumina used in the support is a mixture preferably containing from about 50 to about 75 weight percent gamma alumina and from about 25 to about 50 weight percent peptized Catapal alumina. One preferred catalyst comprises about 4 weight percent nickel (measured as NiO) and about 22 weight percent tungsten (measured as $WO_3$) on a support comprising about 30 weight percent of silicalite dispersed in about 70 weight percent of the alumina mixture. An alternative preferred catalyst comprises a support of about 80 weight percent silicalite dispersed in 20 weight percent of the alumina mixture. Another alternative preferred catalyst is an isodewaxing type catalyst containing noble metal.

The operating conditions of the hydrodewaxing reactor preferably include a pressure between about 1500 and 2500 psig, preferably between about 1800 and 2100 psig, most preferably about 2000 psig and a temperature between about 650° to 800° F., preferably between 700° and 750° F., most preferably about 700° F. The feed is passed through the hydrodewaxing reactor at a liquid hourly space velocity (LHSV) between about 0.5 and 5 $hr^{-1}$.

The resulting effluent from the hydrodewaxing reaction zone is introduced into a high pressure separator to remove hydrogen and any normally gaseous hydrocarbons as a vapor phase and to produce a liquid stream containing lube oil fractions which is subsequently introduced into a vacuum column to separate the lube oil fractions into their respective product streams.

Dewaxing may also be accomplished by utilizing conventional solvent dewaxing technology.

In a preferred embodiment, the remainder of the effluent from the first hydrocracking reaction zone and a liquid recycle stream is introduced into a second hydrocracking reaction zone to convert at least a majority of the original feedstock to the process. In another preferred embodiment, a liquid recycle stream may be introduced into the first hydrocracking zone.

Preferred hydrocracking catalysts for the second hydrocracking reaction zone include those hydrocracking catalysts described hereinabove and hydrocracking catalysts comprising a support of refractory oxide, generally including a cracking component such as a molecular sieve, for example, together with a hydrogenation component such as a Group VIII metal component and a Group VIB metal component generally dispersed on a support. More specifically, the hydrocracking catalyst preferably contains between about 5 and 50 weight percent of a Group VIB metal component, measured as the trioxide, and/or between about 2 and 20 weight percent of a Group VIII metal component, measured as the monoxide, supported on a suitable refractory oxide. Preferred Group VIII metal components include nickel and cobalt, and preferred Group VIB metal components include molybdenum and tungsten. Suitable refractory oxides include silica, silica-alumina, silica-magnesia, silica-titania, with alumina being preferred. The support contains a cracking component, for example, between about 5 and 90 weight percent of a large pore crystalline molecular sieve. Preferred molecular sieves include large pore crystalline aluminosilicates such as Y zeolite, for example.

Preferred catalysts for the second hydrocracking reaction zone comprise a hydrogenation component on a support comprising a crystalline molecular sieve and a dispersion of silica-alumina in an alumina matrix. Such preferred catalysts can be produced, for example, by mixing about 10 weight percent powdered LZ-10 that has been ion exchanged with ammonium nitrate to reduce the sodium content to about 0.1 weight percent with a dispersion of spray dried, powdered silica-alumina in alumina. The dispersion can be made by mixing about 44 parts by weight of a 45/55 silica-alumina graft co-polymer and about 56 parts by weight of hydrous alumina gel. The final catalyst support consists of essentially 10 weight percent LZ-10 in the hydrogen form, about 70 weight percent of a dispersion consisting overall of about 45 weight percent silica and 55 weight percent alumina and about 20 weight percent Catapal alumina for the binder. The calcined catalyst support is then impregnated with a solution of nickel nitrate and ammonium metatungstate. After removing the excess liquid, the catalyst is dried and calcined in flowing air. The final catalyst contains about 4 weight percent nickel (as NiO) and 24.2 weight percent tungsten (as $WO_3$).

The second hydrocracking reaction zone is preferably operated at conditions including a temperature from about 450° F. to about 750° F., a pressure from about 1500 to about 2500 psig, a liquid hourly space velocity (LHSV) from about 0.5 to about 5 $hr^{-1}$.

The resulting effluent from the second hydrocracking reaction zone is passed into a high pressure separator preferably maintained at a pressure from about 1500 to about 2500 psig. A hydrogen-rich gaseous stream is removed from the high pressure separator and at least a portion is utilized as recycle hydrogen to one or both of the hydrocracking reaction zones. A liquid hydrocarbon stream is removed from the high pressure separator and introduced into a product fractionator to preferably produce product streams including naphtha, kerosene and diesel. A bottom stream from the product fractionator is preferably recycled to the second hydrocracking reaction zone for additional conversion to lower boiling hydrocarbons.

DETAILED DESCRIPTION OF THE DRAWING

In the drawing, the process of the present invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a heavy hydrocarbon feedstock is introduced into the process via line 1 and is admixed with a hydrogen-rich recycle gas stream provided via line 31 and the resulting admixture is transported via line 2 and introduced into hydrocracking zone 3. A liquid stream containing lube oil boiling range hydrocarbons is removed from hydrocracking zone 3 via conduit 4 and introduced into low pressure separator 5. A gaseous stream containing hydrogen and normally gaseous hydrocarbons is removed from low pressure separator 5 via line 6 and recovered. A liquid stream containing dissolved normally gaseous hydrocarbons is removed from low pressure separator 5 via line 7 and introduced into stripper 8. A gaseous stream containing normally gaseous hydrocarbons is removed from stripper 8 via conduit 21 and recovered. A stripped liquid containing lube oil boiling range hydrocarbons is removed from stripper 8 via line 9 and is admixed with a hydrogen-rich stream provided via line 10 and the resulting admixture is introduced via line 9 into hydrodewaxing reaction zone 11. A resulting dewaxed hydrocarbon stream is removed from hydrodewaxing zone 11 via line 12 and is introduced into high pressure separator 13. A gaseous stream containing hydrogen and normally gaseous hydrocarbons is removed from high pressure separator 13 via line 14 and recovered. A liquid stream containing lube oil boiling range hydrocarbons is removed from high pressure separator 13 via line 15 and introduced into vacuum fractionation column 16. A heavy lube oil stream is removed from vacuum fractionation column 16 via line 19. A medium lube oil stream is removed from vacuum fractionation column 16 via line 18 and recovered. A light lube oil stream is also removed from vacuum fractionation column 16 via line 17 and recovered. A stream containing hydrocarbons boiling below the lube oil boiling range is removed from vacuum fractionation column 16 via line 20 and is eventually recovered from the process as described below.

Another stream containing both liquid and vapor is removed from hydrocracking zone 3 via line 22 and is admixed with a liquid recycle stream supplied by line 41 and the resulting admixture is transported by line 23 which is contacted with a hydrogen-rich recycle gas stream provided via line 32 and the resulting admixture is introduced into hydrocracking reaction zone 25 via line 24. The resulting effluent from hydrocracking zone 25 is transported via line 26 and introduced into high pressure separator 27. A hydrogen-rich gaseous stream is removed from high pressure separator 27 via line 28 and is admixed with makeup hydrogen provided via line 29 and the resulting admixture is transported via line 30. The resulting hydrogen-rich gaseous stream transported via line 30 is bifurcated into lines 31 and 32 to provide recycle hydrogen-rich gas as described hereinabove. A liquid hydrocarbon stream is removed from high pressure separator 27 via line 33 and is admixed with a stream of hydrocarbons transported via line 20 as described hereinabove. The resulting admixture is carried by line 34 and introduced into product fractionation zone 35. A gaseous stream containing hydrogen and normally gaseous hydrocarbons is removed from product fractionation zone 35 via line 36 and recovered. A naphtha stream is recovered by line 37 and a kerosene stream is recovered via line 38 from product fractionation zone 35. A diesel stream is removed via line 39 from product fractionation zone 35 and recovered. A heavy hydrocarbon bottoms stream is removed by line 40 from product fractionation zone 35 and at least a portion thereof is transported by line 41 as a recycle stream described hereinabove. Another portion is removed and recovered via line 40.

The process of the present invention is further demonstrated by the following illustrative embodiment. This illustrative embodiment is, however, not presented to unduly limit the process of this invention, but to further illustrate the advantages of the hereinabove-described embodiment. The following results were not obtained by the actual performance of the present invention but are considered prospective and reasonably illustrative of the expected performance of the invention based upon sound engineering calculations.

ILLUSTRATIVE EMBODIMENT

A heavy hydrocarbon feedstock in an amount of 100 mass units per hour and having the characteristics of a typical gas oil is admixed with a hydrogen-rich recycle gas stream and then introduced into a first hydrocracking zone to convert about 30 volume percent of the feedstock to lower boiling hydrocarbons. A liquid stream in an amount of 3 mass units per hour is withdrawn from the first hydrocracking zone and introduced into a low pressure separator operated at conditions to remove the diesel boiling range hydrocarbons and lower boiling fractions as vapor to leave the unconverted portion of the feed in the liquid portion. This resulting liquid stream contains the lube oil base stock material and has a high viscosity index and the desired viscosity range as a result of being processed in the partial conversion first hydrocracking zone. However, this liquid stream contains normal paraffins which results in high pour point. The resulting flash drum liquid is sent to a catalytic dewaxing section wherein the liquid is stripped to remove hydrocarbons boiling below the lube oil boiling range. The resulting stripped liquid in an amount of 1 mass units per hour is introduced along with a hydrogen-rich gas to a catalytic dewaxing reaction zone. The resulting dewaxed effluent from the catalytic dewaxing reaction zone is introduced into a high pressure separator to remove lower boiling hydrocarbons and non-condensables including hydrogen. The resulting liquid is introduced into a vacuum fractionation zone to produce lubricating oil base stocks. A combined liquid and gas stream in an amount of 97 mass units per hour is removed from the first hydrocracking zone and directly introduced into a second hydrocracking zone to convert about another 30 volume percent of the original feedstock to lower boiling feedstocks. The resulting effluent from the second hydrocracking zone is introduced into a high pressure separator operated at essentially the same pressure as the second hydrocracking zone to produce a hydrogen-rich gaseous stream and a liquid stream. The resulting liquid stream is introduced into a product fractionator to produce naphtha, kerosene, diesel and unconverted oil. The unconverted oil separated and recovered in the product fractionator is recycled to the second hydrocracking zone for further conversion to lower boiling hydrocarbons.

The foregoing description, drawing and illustrative embodiment clearly illustrate the advantages encompassed by the process of the present invention and the benefits to be afforded with the use thereof.

What is claimed:

1. A process for the production of lubricating oil base stocks comprising:

(a) hydrocracking a heavy hydrocarbon feedstock comprising essentially all of its components boiling above about 650° F. in a first hydrocracking zone with hydrogen under conditions to convert at least about 20% of the feedstock into components boiling at less than about 650° F. to produce a liquid stream comprising unconverted hydrocarbon compounds and lube oil boiling range hydrocarbons;

(b) withdrawing at least a portion of said liquid stream produced in step (a) from said first hydrocracking zone and producing at least one hydrocarbon stream having a boiling range below about 700° F. and comprising lube oil boiling range hydrocarbon;

(c) hydrodewaxing said stream comprising lube oil boiling range hydrocarbon in a hydrodewaxing reaction zone to produce at least one lubricating oil base stock;

(d) withdrawing at least another portion of said liquid stream produced in step (a) from said first hydrocracking zone and directly introducing said another portion of said liquid stream without intermediate separation into a second hydrocracking zone with hydrogen under hydrocracking conditions to produce a liquid stream comprising unconverted hydrocarbon compounds and hydrocarbons boiling at less than about 650° F.;

(e) separating at least a portion of said liquid stream produced in step (d) to produce at least one hydrocracked product stream having a boiling range less than about 650° F.

2. The process of claim 1 wherein said heavy hydrocarbon feedstock comprises a vacuum gas oil having a boiling range between about 650° F. and about 1050° F.

3. The process of claim 1 wherein said first hydrocracking zone contains a hydrocracking catalyst comprising a Group VIII metal component, a Group VIB metal component and alumina.

4. The process of claim 1 wherein said first hydrocracking zone is operated at hydrocracking conditions including a temperature from about 450° F. to about 750° F., a pressure from about 1500 psig to about 2500 psig and a liquid hourly space velocity from about 0.5 to about 1.5 $hr^{-1}$.

5. The process of claim 1 wherein said hydrodewaxing is conducted in the presence of a catalyst comprising a Group VIII metal component, a Group VIB metal component, alumina and an intermediate pore molecular sieve.

6. The process of claim 1 wherein said hydrodewaxing reaction zone is operated at hydrodewaxing conditions including a pressure from about 1500 psig to about 2500 psig, a temperature from about 650° F. to about 800° F. and a liquid hourly space velocity form about 0.5 to about 1.5 $hr^{-1}$.

7. The process of claim 1 wherein said second hydrocracking zone is operated at conditions including a temperature from about 450° F. to about 750° F., a pressure from about 1500 psig to about 2500 psig and a liquid hourly space velocity from about 0.5 to about 1.5 $hr^{-1}$.

8. The process of claim 1 wherein said second hydrocracking zone contains a hydrocracking catalyst comprising a Group VIII metal component, a Group VIB metal component, alumina and a large pore molecular sieve.

* * * * *